US009401572B1

(12) United States Patent
Jones et al.

(10) Patent No.: US 9,401,572 B1
(45) Date of Patent: Jul. 26, 2016

(54) POSITIONING OF CONTACTS IN AUDIO JACK

(71) Applicant: GOOGLE INC., Mountain View, CA (US)

(72) Inventors: Warren Jones, San Jose, CA (US); Leng Ooi, San Jose, CA (US)

(73) Assignee: Google Inc., Mountain View, CA (US)

( * ) Notice: Subject to any disclaimer, the term of this patent is extended or adjusted under 35 U.S.C. 154(b) by 0 days.

(21) Appl. No.: 14/719,811

(22) Filed: May 22, 2015

(51) Int. Cl.

| | |
|---|---|
| ***H01R 24/58*** | (2011.01) |
| ***H01R 13/641*** | (2006.01) |
| ***H01R 13/627*** | (2006.01) |
| *H01R 107/00* | (2006.01) |

(52) U.S. Cl.
CPC ..... *H01R 24/58* (2013.01); *H01R 13/6277* (2013.01); *H01R 13/641* (2013.01); *H01R 2107/00* (2013.01)

(58) Field of Classification Search
USPC ..... 439/668, 584, 669, 188; 1/1
See application file for complete search history.

(56) References Cited

U.S. PATENT DOCUMENTS

| | | | | |
|---|---|---|---|---|
| 4,952,174 | A * | 8/1990 | Sucht | H01R 9/05 439/584 |
| 5,011,432 | A * | 4/1991 | Sucht | H01R 9/05 439/584 |
| 5,830,013 | A * | 11/1998 | Saito | H01R 13/4362 439/595 |
| 6,220,898 | B1 * | 4/2001 | Wu | H01R 24/58 439/188 |
| 7,316,587 | B2 | 1/2008 | Chien et al. | |
| 8,362,654 | B2 * | 1/2013 | Inha | H03K 17/687 307/112 |
| 8,419,481 | B2 * | 4/2013 | Chai | H01R 13/6485 439/660 |
| 8,428,288 | B2 * | 4/2013 | Lim | H04R 1/1066 381/384 |
| 8,715,011 | B2 * | 5/2014 | Chen | H01R 13/187 439/188 |
| 9,103,866 | B2 * | 8/2015 | Mehrabi | G01R 31/04 |
| 9,148,718 | B2 * | 9/2015 | Breece, III | H04R 1/1041 |
| 2007/0123111 | A1 * | 5/2007 | Chien | H01R 12/58 439/668 |
| 2007/0218774 | A1 * | 9/2007 | Han | H01R 24/58 438/668 |
| 2013/0020882 | A1 | 1/2013 | Prentice | |
| 2013/0021046 | A1 * | 1/2013 | Prentice | H04R 29/004 324/705 |
| 2014/0241535 | A1 | 8/2014 | Poulsen et al. | |

* cited by examiner

*Primary Examiner* — Alexander Gilman
(74) *Attorney, Agent, or Firm* — Brake Hughes Bellermann LLP

(57) ABSTRACT

An electronic device may include an audio jack allowing a peripheral audio output device to be connected to the electronic device by inserting the plug into the jack. The jack may include a receptacle that extends into the housing. A plurality of contacts may be included in the receptacle, arranged along a longitudinal direction of the receptacle. A latch may be installed in the receptacle, at an intermediate location between the proximal end and the distal end of the receptacle, to secure a position of the plug in the receptacle. A detect contact may be positioned at the distal end of the receptacle, separate from the latch. The detect contact may be actuated by the distal end of the tip of the plug to indicate that the plug is fully inserted in the receptacle. Upon actuation of the detect contact, the device may transfer audio output functionality to the peripheral device connected to the device by the plug inserted in the jack.

17 Claims, 6 Drawing Sheets

POSITIONING OF CONTACTS IN AUDIO JACK

FIELD

This document relates, generally, to a receptacle for a plug, and in particular, to an audio jack for an electronic device.

BACKGROUND

Electronic devices such as, for example, desktop and laptop computers, tablets, smartphones, multimedia players and the like may include an audio jack. A plug may be inserted into the audio jack to connect earphones/headphones and/or a microphone to the device. As the plug is inserted into the jack, terminal(s) arranged along the plug may establish contact with corresponding contact(s) arranged along the receptacle to establish connection(s) between the plug and the electronic device and switch an audio output function from, for example, a speaker of the device, to the earphones/headphones connected to the plug.

SUMMARY

In one aspect, a device may include a housing, a receptacle extending into the housing and configured to removably receive a plug therein, a latch included in the receptacle and configured to engage the plug so as to secure the plug in a predetermined position of in the receptacle when the latch is engaged by the plug, a plurality of contacts included in the receptacle, the plurality of contacts including a detect contact at a distal end of the receptacle, the detect contact configured to be actuated by contact with a distal end of the plug, the detect contact being configured to generate a signal indicating full insertion of the plug in the receptacle when actuated by the distal end of the plug, and a controller configured for controlling operation of the device and configured for receiving the generated signal.

In another aspect, a device may include a housing, a receptacle defined by a hollow channel extending into the housing, the channel including an open proximal end and terminating at a distal end thereof, a latch installed in the channel, at an intermediate location between the proximal end of the channel and the distal end of the channel, a plurality of contacts arranged along a periphery of the channel, spaced apart along a longitudinal direction of the channel, each of the plurality of contacts configured to contact a respective section of a plug inserted into the channel, and a detect contact positioned at the distal end of the channel and configured to trigger a change in functionality of the device in response to contact with a distal end of a tip of the plug.

In another aspect, a method may include receiving a plug in a receptacle of an electronic device, including establishing contact between an outer circumferential surface of the plug and a plurality of contacts arranged along a periphery of the receptacle as the plug moves from a proximal end toward a distal end of the receptacle, the plurality of contacts being spaced apart along a longitudinal direction of the receptacle, establishing engagement between a latch in the receptacle and the plug, and establishing contact between a detect contact at the distal end of the receptacle and a distal end of a tip of the plug. The method may also include generating an indicator that the plug is fully inserted into the receptacle in response to establishing contact between the detect contact and the tip end of the plug, and switching at least one function of the electronic device in response to the indicator.

The details of one or more implementations are set forth in the accompanying drawings and the description below. Other features will be apparent from the description and drawings, and from the claims.

DETAILED DESCRIPTION

Figure 1:
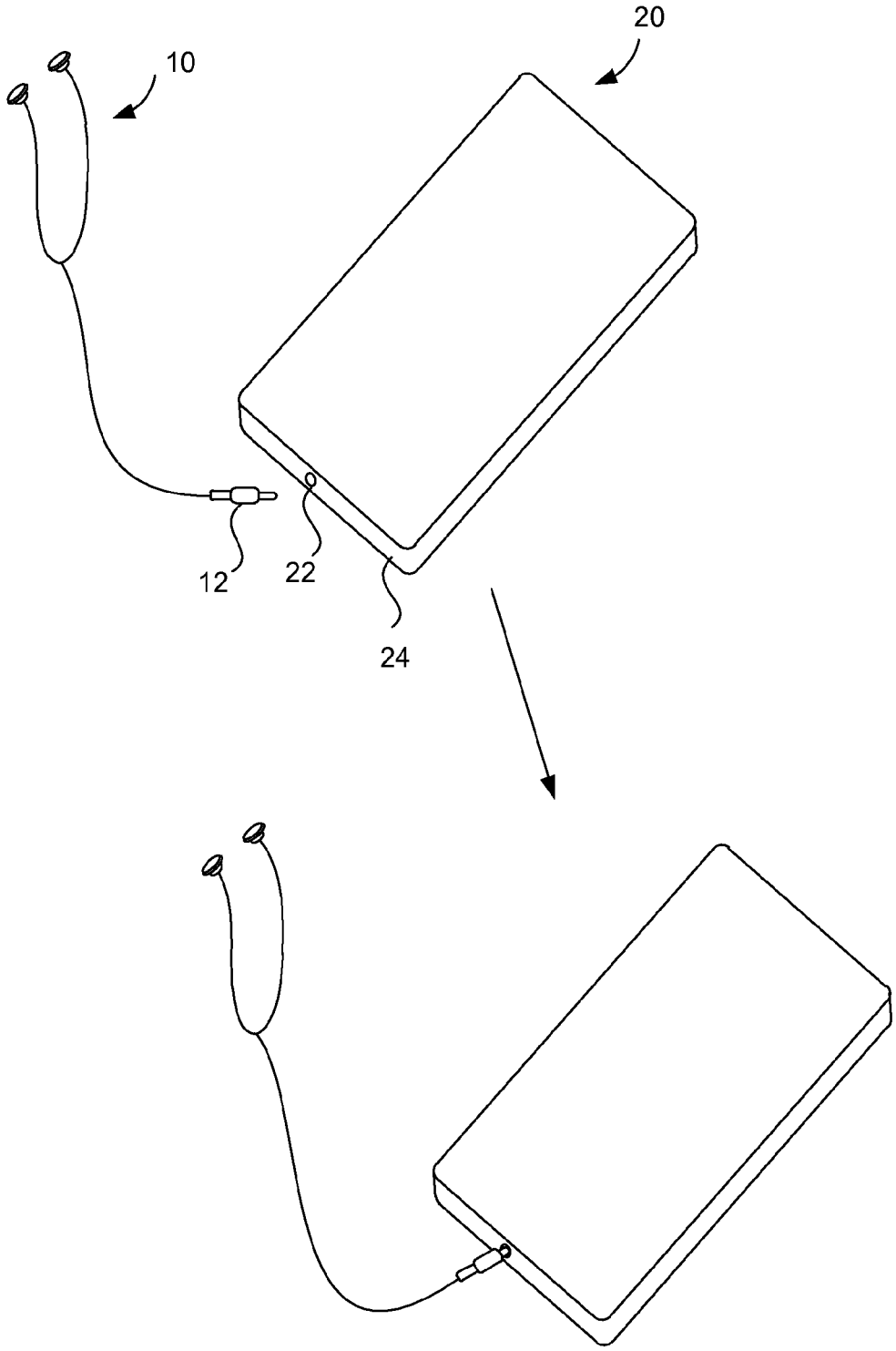
FIG. 1 illustrates an example of an electronic device and earphone assembly, in accordance with embodiments as broadly described herein.

Various different types of electronic devices may include audio jacks to connect a peripheral device having audio output capability to the base device. These peripheral devices may include, for example, headphone/earphone assemblies, standalone speaker systems, and the like. In the example implementation shown in FIG. 1, an earphone assembly 10 is connected to a smartphone 20. The earphone assembly 10 is simply one example of an audio output device that may be connected to an electronic device by an audio jack and plug connection. Similarly, a smartphone 20 is simply one example of an electronic device to which an audio output device, such as the earphone assembly 10, may be connected by a connection between an audio jack and an audio plug. In this example, as the plug 12 of the earphone assembly 10 is inserted into the audio jack 22 defined in the housing 24 of the smartphone 20, a latch included in the audio jack 22 may engage the plug 12 in the jack 22, and a detect contact may detect a full insertion state, or engaged state, of the plug 12 in the jack 22. In response to the detection of the full insertion state, audio output functionality can be transferred from other speakers associated with the smartphone 20 to the earphone assembly 10.

In some embodiments, a detect contact that detects the full insertion state and the latch may be co-located, or coupled, or integrated, into the same structure, as this arrangement may provide an efficient use of space within the jack. In this arrangement, the latch and detect contact may be located at an intermediate position along the insertion length of the jack, where latching and release may be most effective, rather than at the terminal end, or distal end, of the jack. Thus, contact between the detect contact and the plug may be initiated as the plug makes initial contact with the latch, rather than when engagement between the plug and the latch is complete (i.e., when the plug is fully inserted into the jack). However, a delay between the time at which initial engagement of the latch and the plug occurs and the time at which the latch is fully engaged with the plug and the plug is fully inserted in the jack may, in turn, delay the time at which the system is capable of outputting audio output through the headphones after the plug is initially inserted into the jack. The delay in transitioning of the audio output to the headphones may be misinterpreted as, for example, a system malfunction, or may cause user inconvenience.

To compensate for this delay in transitioning audio output from other speakers associated with the device 20 to the speakers in the earphone assembly 10 and potential dead air time associated with such a delay, a timing delay between a point at which contact between the plug and the detection switch is initially detected and the point at which the transition of audio output from the other speakers of the device 20 to the speakers of the earphones 10 may be implemented by the control system of the electronic device. This control system timing delay for initiating transition may allow sufficient time to ensure that the plug is fully inserted and engaged in the jack before the audio output functionality is switched from the speakers of the device to the earphones. Without this timing delay, this ostensible transfer of audio output functionality would occur before the plug is fully engaged in the jack (and before all the contacts between the plug and the jack have been made, which are necessary for quality audio signals to be output through the earphones 10), with audio output essentially lost until the plug is fully inserted and/or engaged. This temporary loss of audio output while the plug is being inserted into the jack may be undesirable to the user, and, in a case in which the plug does not reach the fully inserted position, may provide a false indication of a malfunction due to lack of transfer of the functionality.

Figure 2:
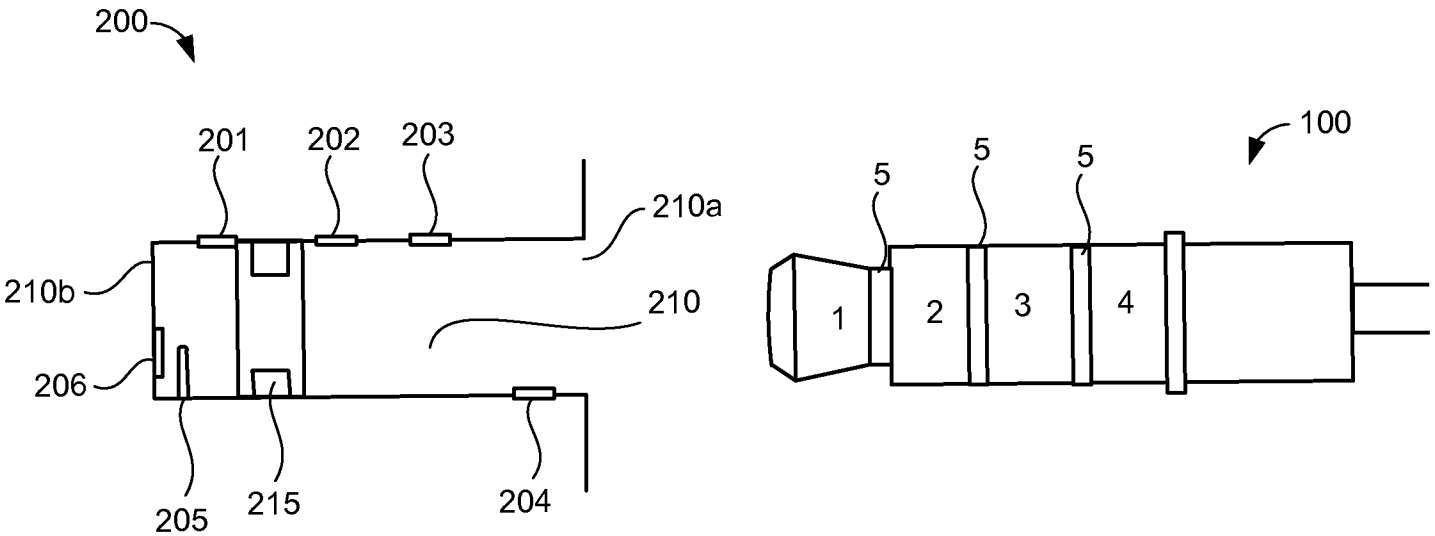
FIG. 2 is a side sectional view of an example audio jack, and an example plug to be inserted into the example audio jack, in accordance with embodiments as broadly described herein.
Figure 3:
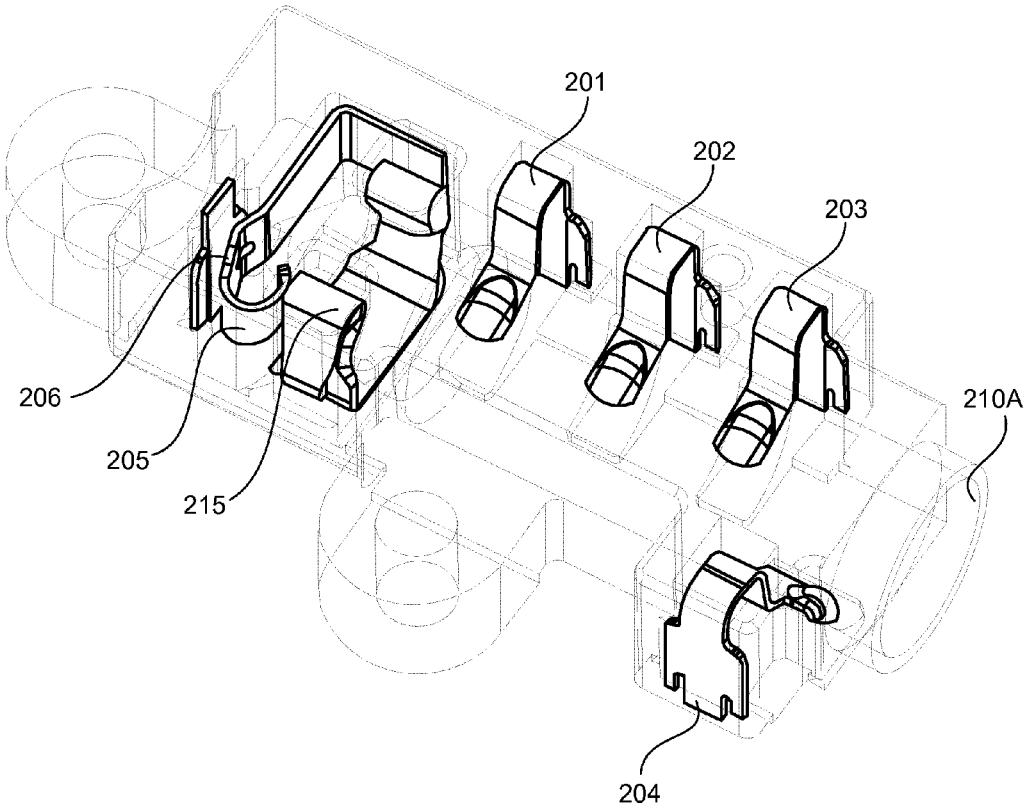
FIG. 3 is a perspective view of the example audio jack shown in FIG. 2, in accordance with embodiments as broadly described herein.

As shown in the example implementation of an audio jack 200 illustrated in FIG. 2 and FIG. 3, in accordance with embodiments as broadly described herein, the latching structure may be decoupled from the detect contact structure, to eliminate the need for this timing delay when inserting a plug, or connector, into an audio jack. The example plug 100 shown in FIG. 2 is a TRRS (tip/ring/ring/sleeve) plug, or connector, including four contacts when connecting, for example, a headset including a speaker and a microphone, to an electronic device. However, the principles and concepts discussed herein may be applied to other types of plugs/connectors, such as, for example, a TRS (tip/ring/sleeve) connector, a simple TS (tip/sleeve) connector, or other configurations, depending on a particular implementation.

As shown in FIG. 2, the example plug 100 may include an electrically conductive sleeve 4, an electrically conductive first ring contact 3, an electrically conductive second ring contact 2, and an electrically conductive tip contact 1. The tip contact 1, first and second ring contacts 2 and 3, and sleeve 4 may be separated by isolating, low-conductivity rings 5. In some embodiments, the sleeve 4 may serve as a ground connection, the tip contact 1 and the second ring contact 2 may convey left and right stereo audio signals, and the second ring contact 3 may convey microphone audio signals.

The example audio jack (or socket) 200, shown in FIG. 2 is a simplified side cross sectional view, shown schematically, for ease of discussion and illustration. The example jack 200 may include a channel shaped receptacle in the housing of the electronic device, initiating at an open proximal end 210*a* and terminating at a distal end 210*b*. In the example shown in FIG. 2, the distal end 210*b* of the receptacle is shown as closed, simply for ease of illustration. However, in some embodiments, the distal end 210*b* may be fully or partially open to, for example, accommodate other components and the like. A sleeve contact 204 may be positioned in the receptacle 210 to contact the sleeve 4 of the inserted plug 100. Ring contacts 202 and 203 may be positioned in the receptacle 210 to contact the first and second rings 2 and 3 of the inserted plug 100. A tip contact 201 and a switch contact 205 may be positioned in the receptacle 210 to contact the tip contact 1 of the inserted plug 100. A detect contact 206 may be positioned at the distal end 210*b* of the receptacle 210 to contact a distal end of the tip contact 1 of the fully inserted plug 1. A latch 215 may be coupled at an intermediate position along the insertion length of the receptacle 210. The latch 215 may be resilient, with, for example, arms that may spread apart to accommodate a larger diameter of one portion of the tip contact 1, and then close in around a smaller diameter, more narrow portion of the plug 100, to secure the plug 100 in the fully inserted position in the receptacle 210.

With the contacts 201-206 arranged in this manner, full insertion of the plug 100 in the jack 200 will not be detected by the detect contact 206 until the plug 100 is fully inserted in the jack 200 and the distal end of the tip contact 1 causes the switch contact 205 to contact the detect contact 206. Audio functionality will not be switched from the other speakers associated with the electronic device to the speakers of the audio output device connected to the plug 100 until full insertion of the plug 100 in the jack 200 is detected by the detect contact 206. Accordingly, in this arrangement, a timing delay in switching functionality from the electronic device to the audio output device connected to the plug 100 may be avoided.

In the example embodiment shown in FIGS. 2 and 3, the contacts 201-206 and latch 215 can be arranged in the receptacle of the audio jack so that full insertion of the plug 100 in the jack 200 is not detected and confirmed until the tip contact 1 of the plug 100 contacts the switch contact 205 and pushes the switch contact 205 into the detect contact 206. In some situations, foreign matter or debris, such as lint, which may inhibit proper contact between the contact(s) on the plug 100 and the contact(s) in the receptacle 210, may infiltrate the receptacle 210. An audio jack 200 including contacts 201-206 and a latch 215 arranged as shown in FIGS. 2 and 3, in accordance with embodiments as broadly described herein, may still allow for proper detection of full insertion of the plug 100 in the audio jack 200.

Figure 4A:
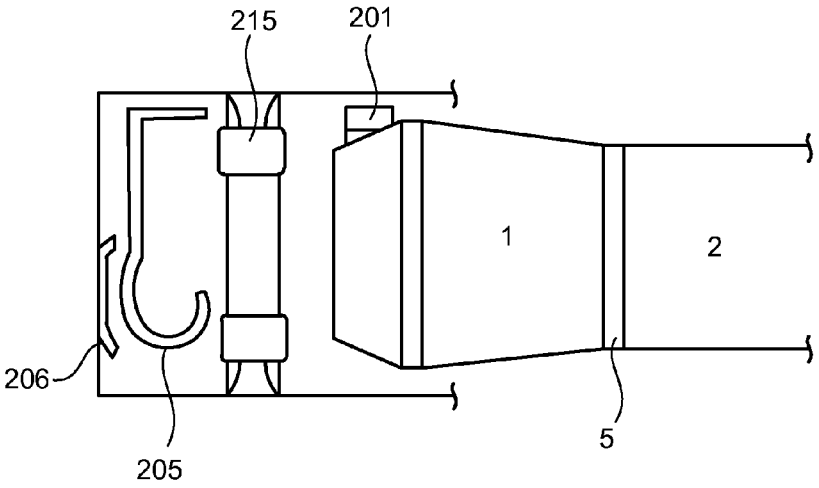
FIGS. 4A-4C are side views illustrating insertion of a plug into the audio jack shown in FIGS. 2 and 3, in accordance with embodiments as broadly described herein.
Figure 4B:
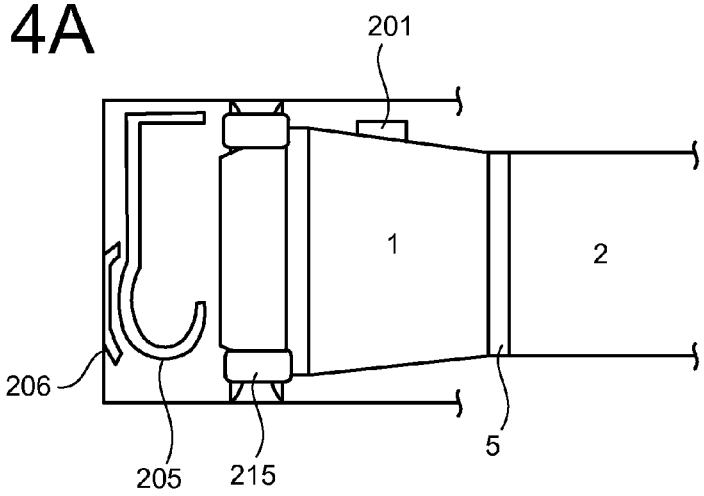
Figure 4C:
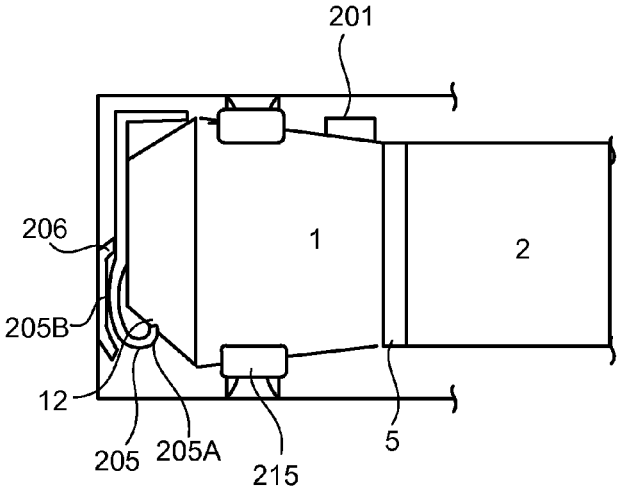

Insertion of the plug 100 into the audio jack 200 illustrated in FIGS. 2 and 3 is shown in FIGS. 4A-4C. In FIG. 4A, the plug 100 is inserted into the receptacle 210, with a tapered distal end of the tip contact 1 of the plug passing the tip contact 201. At this point, the latch 215 is in a neutral, non-expanded state, and the switch contact 205 is in a neutral state, with a space between the switch contact 205 and the detect contact 206 such that the detect contact 206 is not activated. In the state shown in FIG. 4A, audio output of the electronic device is output through other speaker(s) of the device, which are not connected to the plug 100.

In FIG. 4B, the plug 100 has advanced into the receptacle 210 so that the widest portion of the tip contact 1 is positioned in the latch 215, causing the latch 215 to expand to accommodate this portion of the tip contact 1. At this point, the switch contact 205 remains in the neutral state, maintaining the space between the switch contact 205 and the detect contact 206 such that the detect contact 206 is not activated, and audio output of the electronic device continues to be output through speaker(s) of the device.

In FIG. 4C, the plug has advanced into the receptacle so that the widest portion of the tip contact 1 has passed through the latch 215. As the tapered distal end of the tip contact 1 continues to move toward the distal end 210*b* of the receptacle 210, a tapered distal surface 12 of the tip contact 1 may press against a first contact portion 205*a* of the contact switch 205. As the plug 100 is fully inserted and the tapered distal surface 12 of the tip contact 1 continues to press against the first contact portion 205*a* of the switch contact 205, a second contact portion 205*b* of the switch contact 205 presses against, and actuates the detect contact 206, with the latch 215 in a retracted state to grasp a corresponding outer circumferential portion of the tip contact 1 and secure the position of the plug 100 in the audio jack 200. At this point, the detect contact 206 has been actuated by contact with the tapered distal end of the tip contact 1 of the plug 100 and the latch 215 is in a fully engaged state with the plug 100, and audio output of the electronic device is switched from speaker(s) of the device to an audio output device to which the plug 100 is connected, without a time delay or lapse in audio output.

As noted above, the latch 215 may be somewhat resilient, so that as the widest portion of the plug 100 passes through the latch 215, the latch 215 can expand to accommodate the movement of this portion of the plug 100 through the latch 215, and can then retract to grasp and hold an outer circumferential surface of a subsequent portion of the plug 100 to secure the plug 100 in place in the jack 200. A predetermined insertion force applied in an insertion direction as the plug 100 is inserted into the jack 200 may cause the latch 215 to temporarily expand as shown in FIG. 4B. Continued application of the insertion force as the plug 100 moves past the point shown in FIG. 4B to the point shown in FIG. 4C may cause the latch 215 to retract to grasp and hold the plug 100. In some embodiments, the user inserting the plug 100 may experience a form of tactile feedback as the latch 215 snaps into the retracted position and engages the plug 100.

In a similar manner, when removing the plug 100 from the jack 200, from a position at which the plug 100 in the fully inserted position as shown in FIG. 4C, a predetermined removal force applied to the plug 100 in the removal direction by a user may cause the latch 215 to temporarily expand as the widest portion of the plug 100 passes through the latch 215, as shown in FIG. 4B. Continued application of the removal force in the removal direction may cause the latch 215 to release the plug 100 for removal from the jack 200, as shown in FIG. 4A. In some embodiments, the user removing the plug 100 may experience a form of tactile feedback as the latch 215 releases the plug 100.

Figure 5:
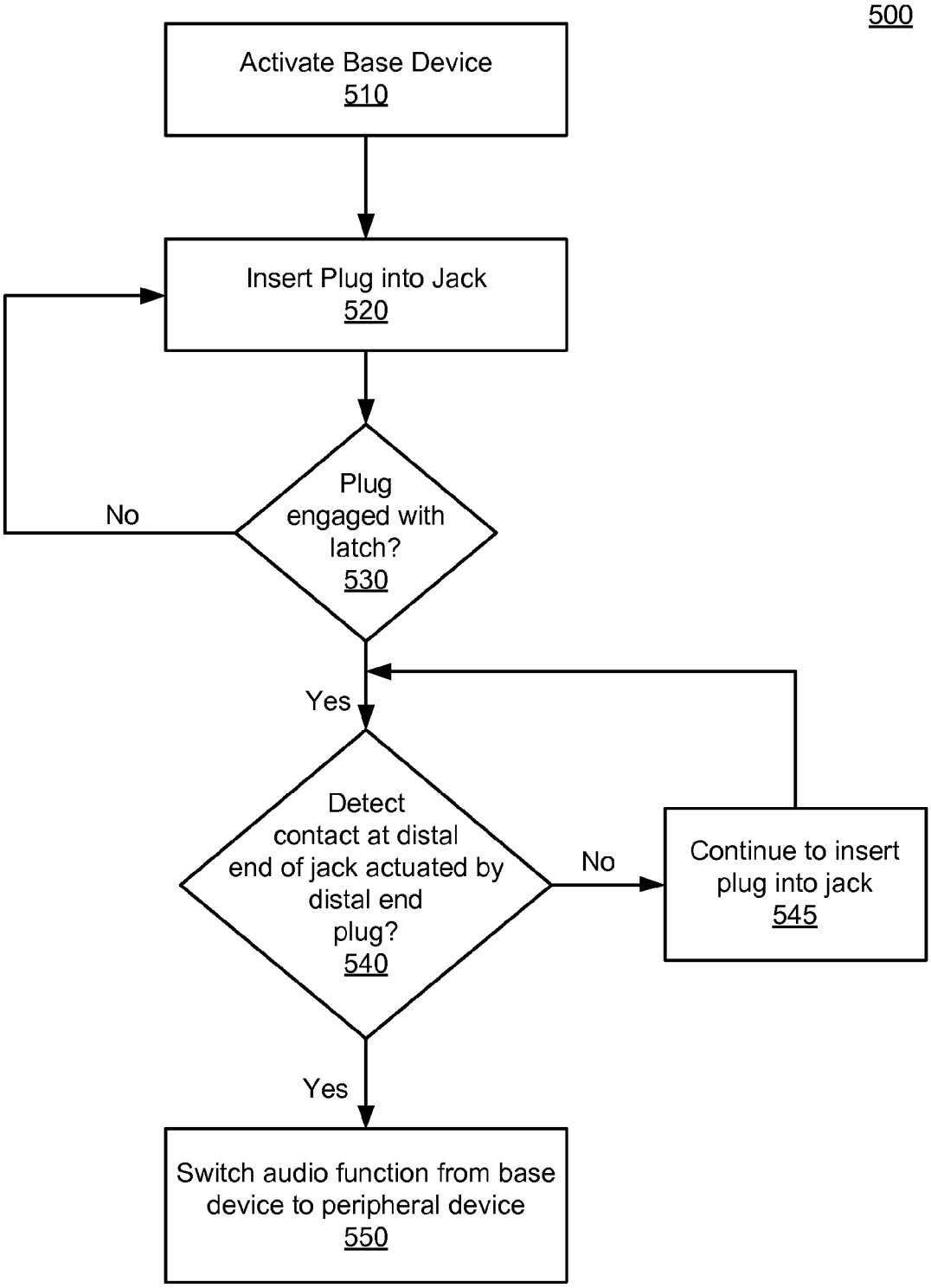
FIG. 5 is a flowchart of a method of operating an audio jack in an electronic device, in accordance with embodiments as broadly described herein.

A method of establishing contact between a plug of a peripheral audio output device and an audio jack of an electronic device, in accordance with embodiments as broadly described herein, and of confirming full insertion of the plug in the audio jack prior to switching audio output functionality from the electronic device to the peripheral audio output device, is shown in FIG. 5.

In the method 500 shown in FIG. 5, first a base electronic device capable of audio output may be activated (block 510). The base electronic device may include an audio jack, in accordance with embodiments as broadly described herein, capable of receiving a plug to connect a peripheral audio output device to the base electronic device, so that audio output functionality may be transferred between the base electronic device and the peripheral audio output device. As the plug is moved into the audio jack (block 520), contacts arranged along an interior of the jack, in particular, along a longitudinal direction of the interior of the jack, may begin to initiate contact with corresponding contact areas arranged along a length of the plug. If the plug has reached an engagement position with a latch provided in the jack (block 530), it is then determined whether a distal tip end of the plug has actuated a detect contact at a terminal end, or distal end, of the interior of the audio jack (block 540). If the detect contact has not been actuated by the distal tip end of the plug, insertion of the plug continues (block 545) until the detect contact is actuated by the distal tip end of the plug (block 540).

Once it is confirmed that the distal tip end of the plug has actuated the detect contact (block 540), by, for example, a signal generated by the detect contact to a controller and/or processor of the base electronic device, with the latch engaged with the plug, the controller and/or processor of the base electronic device may switch audio output functionality switched from the base electronic device to the peripheral audio output device (block 550).

As noted above, in an audio jack as embodied and broadly described herein, the latch is not structurally and/or operably coupled to the detect contact, and the detect contact is located at the terminal end, or distal end of the receptacle of the audio jack in which the plug is inserted, so that the detect contact cannot be physically actuated until the plug is fully inserted into the jack and engaged/secured in position by the latch. Due to this decoupling of the latch and the detect contact, and the positioning of the detect contact at the distal end of the receptacle, audio functionality may be switched from the base electronic device to the peripheral audio output device upon actuation of the detect contact, without implementing a timing delay in switching functionality which the user may otherwise misinterpret as a malfunction of one or both devices.

Figure 6:
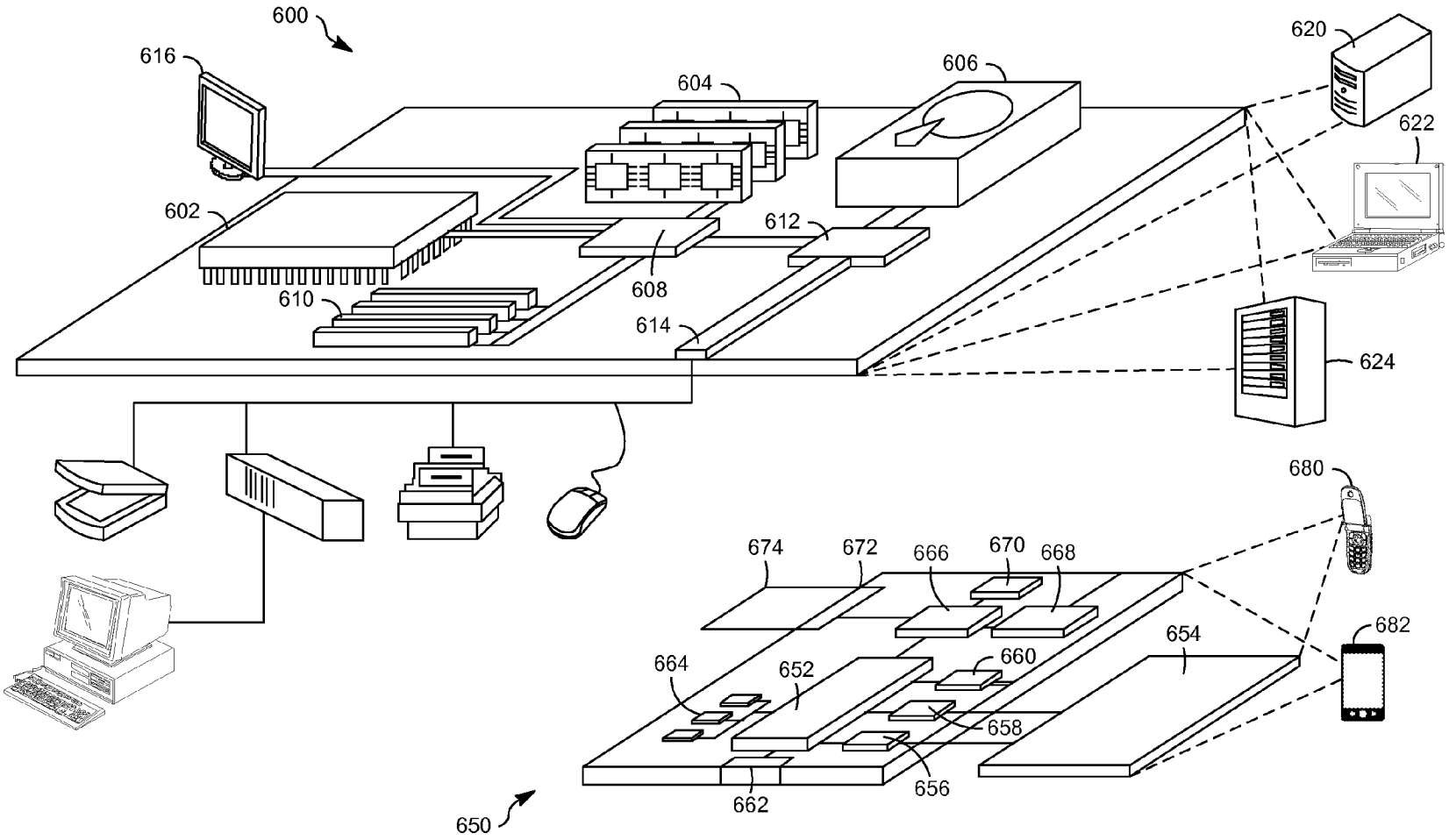
FIG. 6 illustrates an example of a computing device and a mobile computing device that can be used to implement the techniques described herein.

As noted above, a smartphone 20 is shown in FIG. 1, simply for ease of discussion and illustration. However, numerous other base electronic device may include an audio jack in accordance with embodiments as broadly described herein. For example, FIG. 6 provides an example of such a generic electronic computing device 600 and a generic mobile electronic computing device 680, as discussed above, illustrating some of the components of the respective computing devices. Computing device 600 is intended to represent various forms of digital computers, such as laptop computers, convertible computers, tablet computers, desktop computers, workstations, personal digital assistants, servers, blade servers, mainframes, and other appropriate computers. Computing device 680 is intended to represent various forms of mobile devices, such as personal digital assistants, cellular telephones, smart phones, and other similar computing devices. The components shown here, their connections and relationships, and their functions, are meant to be exemplary only, and are not meant to limit implementations of the inventions described and/or claimed in this document.

Computing device 600 includes a processor 602, memory 604, a storage device 606, a high-speed interface 608 connecting to memory 604 and high-speed expansion ports 610, and a low speed interface 612 connecting to low speed bus 614 and storage device 606. Each of the components 602, 604, 606, 608, 610, and 612, are interconnected using various busses, and may be mounted on a common motherboard or in other manners as appropriate. The processor 602 can process instructions for execution within the computing device 600, including instructions stored in the memory 604 or on the storage device 606 to display graphical information for a GUI on an external input/output device, such as display 616 coupled to high speed interface 608. In other implementations, multiple processors and/or multiple buses may be used, as appropriate, along with multiple memories and types of memory. Also, multiple computing devices 600 may be connected, with each device providing portions of the necessary operations (e.g., as a server bank, a group of blade servers, or a multi-processor system).

The memory 604 stores information within the computing device 600. In one implementation, the memory 604 is a volatile memory unit or units. In another implementation, the memory 604 is a non-volatile memory unit or units. The memory 604 may also be another form of computer-readable medium, such as a magnetic or optical disk.

The storage device 606 is capable of providing mass storage for the computing device 600. In one implementation, the storage device 606 may be or contain a computer-readable medium, such as a floppy disk device, a hard disk device, an optical disk device, or a tape device, a flash memory or other similar solid state memory device, or an array of devices, including devices in a storage area network or other configurations. A computer program product can be tangibly embodied in an information carrier. The computer program product may also contain instructions that, when executed, perform one or more methods, such as those described above. The information carrier is a computer- or machine-readable medium, such as the memory 604, the storage device 606, or memory on processor 602.

The high speed controller 608 manages bandwidth-intensive operations for the computing device 800, while the low speed controller 612 manages lower bandwidth-intensive operations. Such allocation of functions is exemplary only. In one implementation, the high-speed controller 608 is coupled to memory 604, display 616 (e.g., through a graphics processor or accelerator), and to high-speed expansion ports 610, which may accept various expansion cards (not shown). In the implementation, low-speed controller 612 is coupled to storage device 606 and low-speed expansion port 614. The low-speed expansion port, which may include various communication ports (e.g., USB, Bluetooth, Ethernet, wireless Ethernet) may be coupled to one or more input/output devices, such as a keyboard, a pointing device, a scanner, or a networking device such as a switch or router, e.g., through a network adapter.

The computing device 600 may be implemented in a number of different forms, as shown in the figure. For example, it may be implemented as a standard server 620, or multiple times in a group of such servers. It may also be implemented as part of a rack server system 624. In addition, it may be implemented in a personal computer such as a laptop computer 622. Alternatively, components from computing device 600 may be combined with other components in a mobile device (not shown), such as device 680. Each of such devices may contain one or more of computing device 600, 680, and an entire system may be made up of multiple computing devices 600, 680 communicating with each other.

Computing device 680 includes a processor 682, memory 664, and an input/output device such as a display 684, a communication interface 666, and a transceiver 668, among other components. The device 680 may also be provided with a storage device, such as a microdrive or other device, to provide additional storage. Each of the components 680, 682, 664, 684, 666, and 668, are interconnected using various buses, and several of the components may be mounted on a common motherboard or in other manners as appropriate.

The processor 682 can execute instructions within the computing device 680, including instructions stored in the memory 664. The processor may be implemented as a chipset of chips that include separate and multiple analog and digital processors. The processor may provide, for example, for coordination of the other components of the device 680, such as control of user interfaces, applications run by device 680, and wireless communication by device 680.

Processor 682 may communicate with a user through control interface 688 and display interface 686 coupled to a display 684. The display 684 may be, for example, a TFT LCD (Thin-Film-Transistor Liquid Crystal Display) or an OLED (Organic Light Emitting Diode) display, or other appropriate display technology. The display interface 686 may comprise appropriate circuitry for driving the display 684 to present graphical and other information to a user. The control interface 688 may receive commands from a user and convert them for submission to the processor 682. For example, the control interface 688 may receive in input entered by a user via, for example, the keyboard 680, and transmit the input to the processor 682 for processing, such as, for entry of corresponding text into a displayed text box. In addition, an external interface 662 may be provide in communication with processor 682, so as to enable near area communication of device 680 with other devices. External interface 662 may provide, for example, for wired communication in some implementations, or for wireless communication in other implementations, and multiple interfaces may also be used.

The memory 664 stores information within the computing device 680. The memory 864 can be implemented as one or more of a computer-readable medium or media, a volatile memory unit or units, or a non-volatile memory unit or units. Expansion memory 674 may also be provided and connected to device 880 through expansion interface 672, which may include, for example, a SIMM (Single In Line Memory Module) card interface. Such expansion memory 674 may provide extra storage space for device 680, or may also store applications or other information for device 680. Specifically, expansion memory 674 may include instructions to carry out or supplement the processes described above, and may include secure information also. Thus, for example, expansion memory 674 may be provide as a security module for device 880, and may be programmed with instructions that permit secure use of device 880. In addition, secure applications may be provided via the SIMM cards, along with additional information, such as placing identifying information on the SIMM card in a non-hackable manner.

The memory may include, for example, flash memory and/or NVRAM memory, as discussed below. In one implementation, a computer program product is tangibly embodied in an information carrier. The computer program product contains instructions that, when executed, perform one or more methods, such as those described above. The information carrier is a computer- or machine-readable medium, such as the memory 664, expansion memory 874, or memory on processor 682, that may be received, for example, over transceiver 668 or external interface 662.

Device 680 may communicate wirelessly through communication interface 666, which may include digital signal processing circuitry where necessary. Communication interface 66 may provide for communications under various modes or protocols, such as GSM voice calls, SMS, EMS, or MMS messaging, CDMA, TDMA, PDC, WCDMA, CDMA2000, or GPRS, among others. Such communication may occur, for example, through radio-frequency transceiver 668. In addition, short-range communication may occur, such as using a Bluetooth, WiFi, or other such transceiver (not shown). In addition, GPS (Global Positioning System) receiver module 670 may provide additional navigation- and location-related wireless data to device 680, which may be used as appropriate by applications running on device 680.

Device 680 may also communicate audibly using audio codec 660, which may receive spoken information from a user and convert it to usable digital information. Audio codec 660 may likewise generate audible sound for a user, such as through a speaker, e.g., in a handset of device 680. Such sound may include sound from voice telephone calls, may include recorded sound (e.g., voice messages, music files, etc.) and may also include sound generated by applications operating on device 680.

The computing device 680 may be implemented in a number of different forms, as shown in the figure. For example, it may be implemented as a cellular telephone 680. It may also be implemented as part of a smart phone 682, personal digital assistant, or other similar mobile device.

Implementations of the various techniques described herein may be implemented in digital electronic circuitry, or in computer hardware, firmware, software, or in combinations of them. Implementations may implemented as a computer program product, i.e., a computer program tangibly embodied in an information carrier, e.g., in a machine-readable storage device (computer-readable medium), for processing by, or to control the operation of, data processing apparatus, e.g., a programmable processor, a computer, or multiple computers. Thus, a computer-readable storage medium can be configured to store instructions that when executed cause a processor (e.g., a processor at a host device, a processor at a client device) to perform a process. A computer program, such as the computer program(s) described above, can be written in any form of programming language, including compiled or interpreted languages, and can be deployed in any form, including as a stand-alone program or as a module, component, subroutine, or other unit suitable for use in a computing environment. A computer program can be deployed to be processed on one computer or on multiple computers at one site or distributed across multiple sites and interconnected by a communication network.

Method steps may be performed by one or more programmable processors executing a computer program to perform functions by operating on input data and generating output. Method steps also may be performed by, and an apparatus may be implemented as, special purpose logic circuitry, e.g., an FPGA (field programmable gate array) or an ASIC (application-specific integrated circuit).

Processors suitable for the processing of a computer program include, by way of example, both general and special purpose microprocessors, and any one or more processors of any kind of digital computer. Generally, a processor will receive instructions and data from a read-only memory or a random access memory or both. Elements of a computer may include at least one processor for executing instructions and one or more memory devices for storing instructions and data. Generally, a computer also may include, or be operatively coupled to receive data from or transfer data to, or both, one or more mass storage devices for storing data, e.g., magnetic, magneto-optical disks, or optical disks. Information carriers suitable for embodying computer program instructions and data include all forms of non-volatile memory, including by way of example semiconductor memory devices, e.g., EPROM, EEPROM, and flash memory devices; magnetic disks, e.g., internal hard disks or removable disks; magneto-optical disks; and CD-ROM and DVD-ROM disks. The processor and the memory may be supplemented by, or incorporated in special purpose logic circuitry.

To provide for interaction with a user, implementations may be implemented on a computer having a display device, e.g., a cathode ray tube (CRT), a light emitting diode (LED), or liquid crystal display (LCD) monitor, for displaying information to the user and a keyboard and a pointing device, e.g., a mouse or a trackball, by which the user can provide input to the computer. Other kinds of devices can be used to provide for interaction with a user as well; for example, feedback provided to the user can be any form of sensory feedback, e.g., visual feedback, auditory feedback, or tactile feedback; and input from the user can be received in any form, including acoustic, speech, or tactile input.

Implementations may be implemented in a computing system that includes a back-end component, e.g., as a data server, or that includes a middleware component, e.g., an application server, or that includes a front-end component, e.g., a client computer having a graphical user interface or a Web browser through which a user can interact with an implementation, or any combination of such back-end, middleware, or front-end components. Components may be interconnected by any form or medium of digital data communication, e.g., a communication network. Examples of communication networks include a local area network (LAN) and a wide area network (WAN), e.g., the Internet.

Reference throughout this specification to "one embodiment" or "an embodiment" means that a particular feature, structure, or characteristic described in connection with the embodiment is included in at least one embodiment. Thus, the appearances of the phrase "in one embodiment" or "in an embodiment" in various places throughout this specification are not necessarily all referring to the same embodiment. In addition, the term "or" is intended to mean an inclusive "or" rather than an exclusive "or."

While certain features of the described implementations have been illustrated as described herein, many modifications, substitutions, changes and equivalents will now occur to those skilled in the art. It is, therefore, to be understood that the appended claims are intended to cover all such modifications and changes as fall within the scope of the implementations. It should be understood that they have been presented by way of example only, not limitation, and various changes in form and details may be made. Any portion of the apparatus and/or methods described herein may be combined in any combination, except mutually exclusive combinations. The implementations described herein can include various combinations and/or sub-combinations of the functions, components and/or features of the different implementations described.

While certain features of the described implementations have been illustrated as described herein, many modifications, substitutions, changes and equivalents will now occur to those skilled in the art. It is, therefore, to be understood that the appended claims are intended to cover all such modifications and changes as fall within the scope of the implementations. It should be understood that they have been presented by way of example only, not limitation, and various changes in form and details may be made. Any portion of the apparatus and/or methods described herein may be combined in any combination, except mutually exclusive combinations. The implementations described herein can include various combinations and/or sub-combinations of the functions, components and/or features of the different implementations described.

What is claimed is:

1. A device, comprising:

a housing;

a receptacle extending into the housing and configured to removably receive a plug therein;

a latch included in the receptacle and configured to engage the plug so as to secure the plug in a predetermined position of in the receptacle when the latch is engaged by the plug;

a plurality of contacts included in the receptacle, the plurality of contacts including:

a detect contact at a distal end of the receptacle, the detect contact configured to be actuated by contact with a distal end of the plug, the detect contact being configured to generate a signal indicating full insertion of the plug in the receptacle when actuated by the distal end of the plug; and a switch contact configured to selectively contact the detect contact in response to the distal end of the plug being located in a predetermined position in the receptacle; and a controller configured for controlling operation of the device and configured for receiving the generated signal, wherein, in an actuated state of the detect contact, a contact portion of the switch contact directly contacts a contact portion of the detect contact in response to a force applied to the switch contact by the distal end of the plug.

2. The device of claim 1, wherein the plurality of contacts further includes:

at least one ring contact.

3. The device of claim 1, wherein, in a de-actuated state, the contact portion of the switch contact is spaced apart from the contact portion of the detect contact.

4. The device of claim 2, wherein the latch is positioned between the at least one ring contact and the switch contact, and the switch contact is positioned between the latch and the detect contact.

5. The device of claim 1, wherein the latch is resilient, the latch adapting to an outer diameter of the plug as the plug moves in an insertion direction of the receptacle.

6. The device of claim 1, wherein the latch is separated from the switch contact by a first predetermined distance, along a longitudinal direction of the receptacle, and the latch is separated from the detect contact by a second predetermined longitudinal distance, along the longitudinal direction of the receptacle.

7. The device of claim 1, wherein the detect contact is configured to transmit the signal indicating full insertion of the plug in the receptacle to the controller, and the controller is configured to transfer audio functionality from the device to a peripheral device connected to the plug in response to the signal received from the detect contact.

8. The device of claim 7, wherein the latch is separated from the detect contact and the switch contact such that the latch is configured to engage the plug as the plug is inserted into the receptacle, and the controller is configured to transfer audio functionality upon receiving the signal from the detect contact.

9. A device, comprising:

a housing;

a receptacle defined by a hollow channel extending into the housing, the channel including an open proximal end and terminating at a distal end thereof;

a latch installed in the channel, at an intermediate location between the proximal end of the channel and the distal end of the channel;

a plurality of contacts arranged along a periphery of the channel, spaced apart along a longitudinal direction of the channel, each of the plurality of contacts configured to contact a respective section of a plug inserted into the channel, the plurality of contacts including a switch contact; and a detect contact positioned at the distal end of the channel and configured to trigger a change in functionality of the device in response to contact with a distal end of a tip of the plug, wherein the detect contact is actuated when a contact portion of the switch contact is moved and directly contacts a contact portion of the detect contact in response to a force applied to the switch contact by the distal end of the tip of the plug.

10. The device of claim 9, wherein the plurality of also contacts includes:

a sleeve contact; and a plurality of ring contacts.

11. The device of claim 10, wherein the detect contact is positioned at the distal end of the channel, at a first side of the switch contact, spaced apart from the switch contact, and the latch is positioned at a second side of the switch contact, spaced apart from the switch contact.

12. The device of claim 9, wherein the detect contact is configured to transmit a signal indicating full insertion of the plug in the receptacle to a controller of the device in response to actuation of the detect contact.

13. The device of claim 12, wherein the controller is configured to transfer audio functionality from the device to a peripheral device connected to the plug in response to the signal received from the detect contact.

14. The device of claim 9, wherein the latch is separated from the detect contact and the switch contact such that the latch is configured to engage the plug as the plug is inserted into the receptacle, and the controller is configured to transfer audio functionality to a peripheral device connected to the plug upon receiving the signal from the detect contact.

15. The device of claim 9, wherein engagement of the latch with the plug is independent from actuation of the detect contact.

16. A method, comprising:

receiving a plug in a receptacle of an electronic device, including:

establishing contact between an outer circumferential surface of the plug and a plurality of contacts arranged along a periphery of the receptacle as the plug moves from a proximal end toward a distal end of the receptacle, the plurality of contacts being spaced apart along a longitudinal direction of the receptacle;

establishing engagement between a latch in the receptacle and the plug; and establishing contact between a detect contact at the distal end of the receptacle and a distal end of a tip of the plug, including:

contacting a switch contact with the distal end of the tip of the plug, the switch contact being positioned between the latch at an intermediate point in the receptacle and the detect contact at the distal end of the receptacle;

exerting a force on the switch contact with the distal end of the tip of the plug in response to movement of the plug into the receptacle; and moving the switch contact into contact with the detect contact to actuate the detect contact;

generating an indicator that the plug is fully inserted into the receptacle in response to establishing contact between the detect contact and the tip end of the plug; and switching at least one function of the electronic device in response to the indicator.

17. The method of claim 16, wherein generating an indicator that the plug is fully inserted into the receptacle includes transmitting a signal to a controller of the device to switch an audio output function of the electronic device from the electronic device to a peripheral device connected to the plug.

* * * * *